US005718066A

United States Patent [19]

Chemello et al.

[11] Patent Number: 5,718,066

[45] Date of Patent: Feb. 17, 1998

[54] SPORT BOOT WITH AN ADJUSTABLE UPPER

[75] Inventors: Jean-Pierre Chemello, Annecy Le Vieux, France; Giuseppe Garbujo, Montebelluna, Italy

[73] Assignee: Salomon S.A., Metz-Tessy, France

[21] Appl. No.: 627,413

[22] Filed: Apr. 4, 1996

[30] Foreign Application Priority Data

Apr. 6, 1995 [FR] France ..... 95 04298

[51] Int. Cl.[6] ..... A43B 5/04; A43B 21/00

[52] U.S. Cl. ..... 36/117.1; 36/105; 36/50.5

[58] Field of Search ..... 36/117.1, 119.1, 36/50.1, 50.5, 51, 45, 105

[56] References Cited

U.S. PATENT DOCUMENTS

| | | | |
|---|---|---|---|
| 431,761 | 7/1890 | Andretta | 36/50.1 |
| 3,545,107 | 12/1970 | Cinquegrana et al. | 36/105 X |
| 3,665,619 | 5/1972 | Gray | 36/117.1 |
| 4,104,811 | 8/1978 | Salomon | 36/121 |
| 4,317,296 | 3/1982 | Hanson | 36/119.1 |
| 5,054,215 | 10/1991 | Tonel et al. | 36/170 |
| 5,343,640 | 9/1994 | Mattiuzzo et al. | 36/121 |

FOREIGN PATENT DOCUMENTS

| | | | |
|---|---|---|---|
| 0302414 | 2/1989 | European Pat. Off. . | |
| 0371915 | 6/1990 | European Pat. Off. . | |
| 1475936 | 4/1967 | France . | |
| 1477165 | 4/1967 | France . | |
| 1490579 | 4/1967 | France . | |
| 2345960 | 10/1977 | France . | |
| 2357197 | 2/1978 | France . | |
| 2358848 | 2/1978 | France . | |
| 618718 | 9/1935 | Germany | 36/117.1 |
| 2105826 | 8/1972 | Germany . | |
| 3431746 | 3/1985 | Germany . | |
| 87702 | 7/1956 | Norway | 36/117.1 |

*Primary Examiner*—B. Dayoan

*Attorney, Agent, or Firm*—Greenblum & Bernstein P.L.C.

[57] ABSTRACT

A sport boot with an upper which closes by tightening devices for maintaining it on the lower part of the wearer's leg includes a device for adjusting a portion of its contour adapted to modify the envelopment perimeter of the upper, independently of the tightening devices. The adjustment device has a linkage element having a rigidity at least equivalent to that of the wall of the upper, which is fixed rigidly and only on both sides of a scallop to block reciprocally the edges of the latter and to ensure continuity of the upper edge of the upper, a fixing device being provided to be adjustable to vary the spacing of the scallop edges whose lower portion is located toward the base of the upper in the zone corresponding to the transition zone between the lower part of the leg and the ankle of the wearer of the boot.

11 Claims, 4 Drawing Sheets

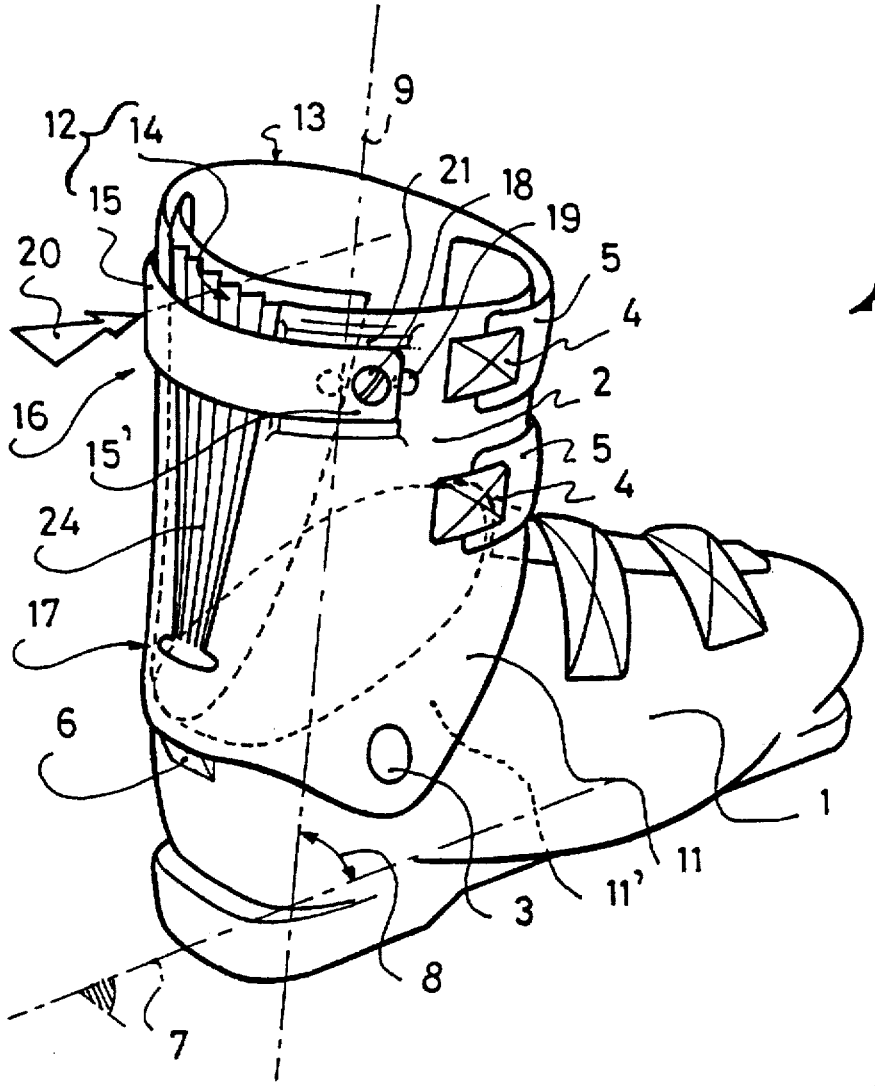
Fig. 1
Fig. 2
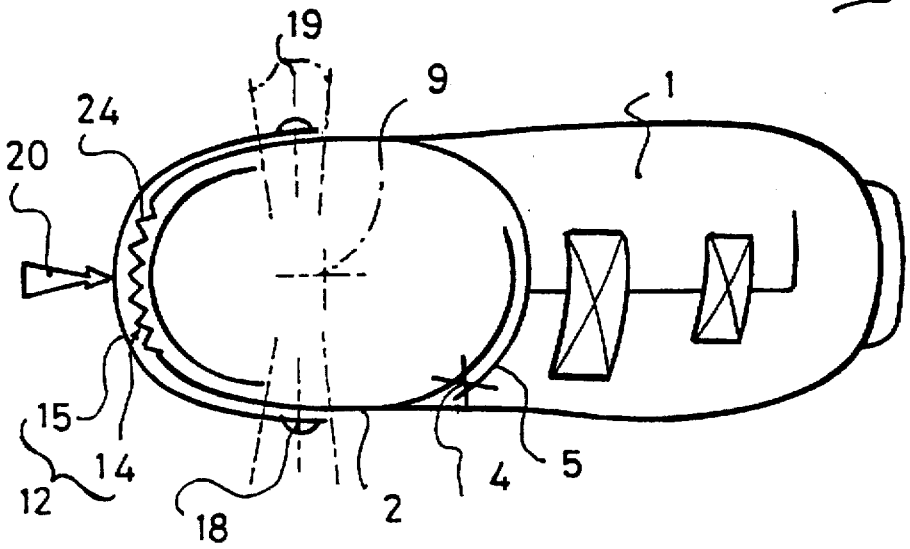

22
19
9
13
10
12
14
15
20
16
15'
18
21
24
17
11
6
4
5
2
4
5
8
7
3
1

12
18
19
2
24
9
20
5
4
22

23
19
9
12
14
10
16
15
13
20
18
15'
21
24
17
11
6
3
4
5
2
4
5
8
1
7

19
18
2
24
9
12
20
5
4
23

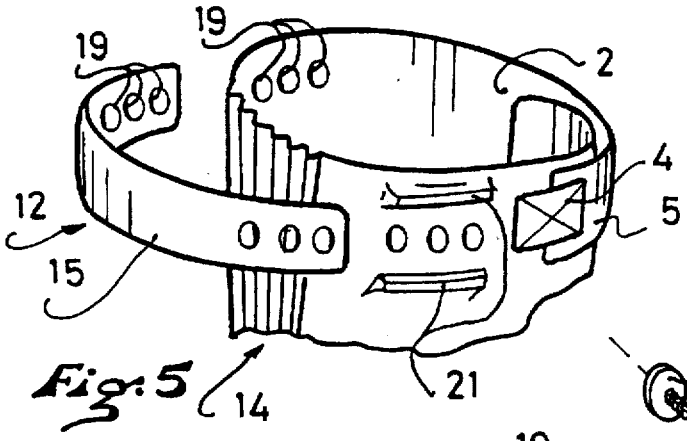
Fig: 5
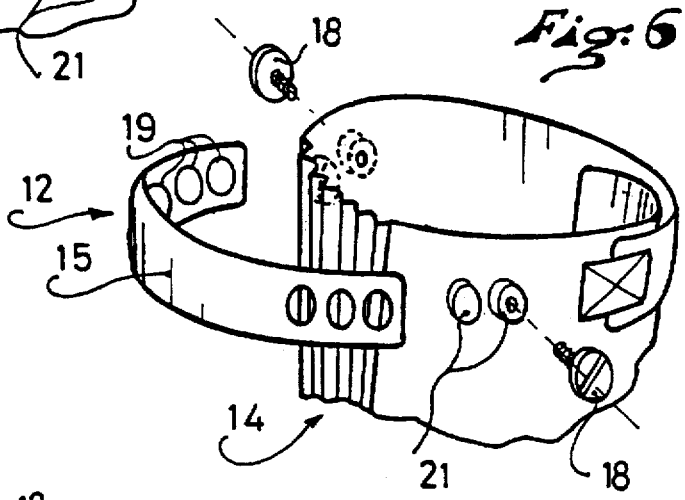
Fig: 6
Fig: 7
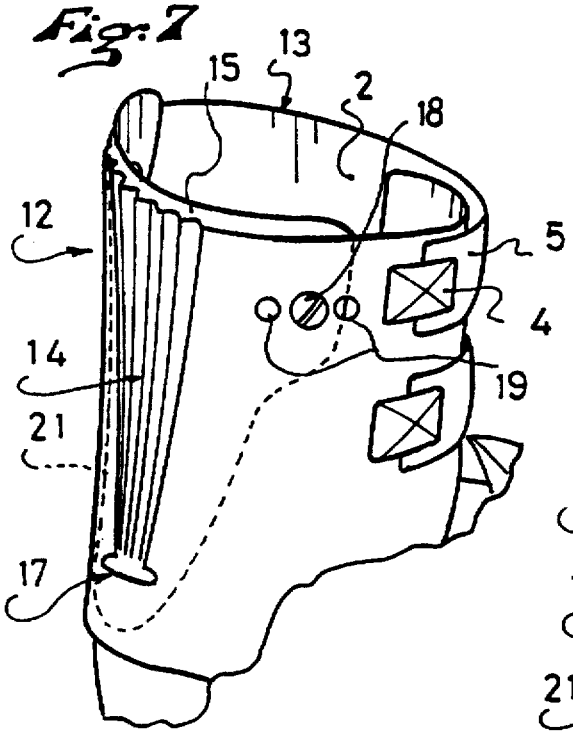
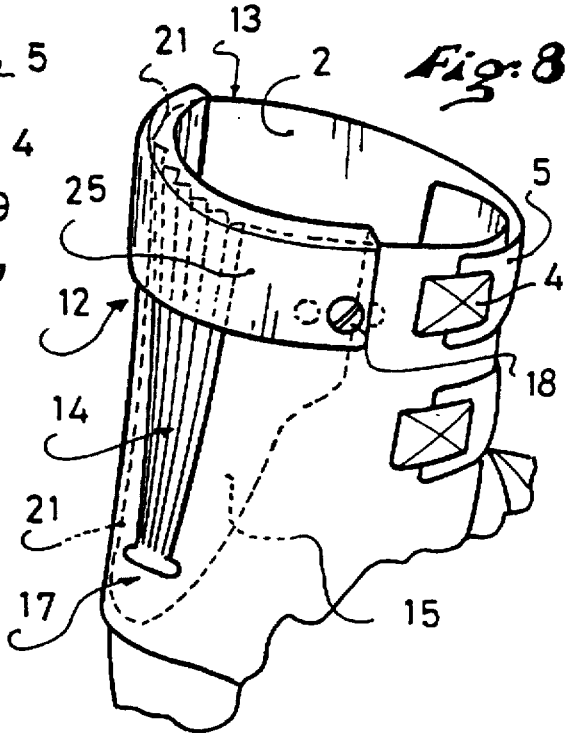
Fig: 8

SPORT BOOT WITH AN ADJUSTABLE UPPER

BACKGROUND OF THE INVENTION

1. Field of the Invention

The present invention relates to a sport boot having a long upper comprising tightening devices for maintaining it on the lower part of the wearer's leg and is related to a device for adjusting a portion of its contour to the configuration of the opposing portion of the lower part of the leg, independently of the tightening devices.

2. Description of Background and Relevant Information

Known adjustment devices of the aforementioned type in ski boots are generally located, for example, on the side of the upper opposite the tightening devices. Their function is to improve the adaptation of the upper portion of the upper to the morphology of the skier's leg, and possibly, to adjust the advance angle. Since the most substantial variations of the leg's morphology are located in the area of the muscle mass, especially calves, it is therefore at the rear portion of the upper that the adjustment devices are most often used. By way of example, the "SAPPORO" boot model marketed by HESCHUNG in 1973–1974, the "VALLUGA" and "TOURING" models by KOFLACH in 1980–1981, as well as the "SUPER COMP" by KASTINGER in 1981–1982, show adjustment devices thus used. Likewise, French Patent Publications No. 2 357 197, German Patent Publication No. 21 05 826, and French Patent Publication No. 1 490 579 describe analogous adjustment devices positioned at the rear portion of the upper of the boots.

These devices have a vertical cut-out or scallop that is upwardly open and provided in the rear portion of the upper. A blocking device with a tensioning element acting on a transverse tongue or cable retains the scallop edges at a given distance that is a function of the length of the tongue or cable rendered active. Thus, when an adaptation to a large calf or a reduction of the advance angle are to be undertaken, one increases the active length of the tongue or cable of the blocking device. The scallop edges can then be spaced to provide passage for the calf or allow for a certain straightening of the leg, i.e., a reduction of the advance angle. In this latter case, it is obvious that the tightening devices of the upper are then tightened so as to always maintain the same envelopment perimeter of the upper on the lower part of the skier's leg.

Conversely, to adjust the upper to a small calf or to increase the advance angle, one reduces the active length of the tongue or cable to cause the edges of the scallop, that come into contact with the calf or push the latter frontward, to come close together, which accentuates the advance angle. In this latter case, the tightening devices of the upper are relaxed so as to always maintain the same envelopment perimeter of the upper on the lower part of the leg.

These adjustment devices are relatively easy to operate, but they require the scallop edges to be elastically deformable and provided originally along a maximum opening position, because the cable blocking devices only function in the direction along which they come close together. As a result from these arrangements, either one of the scallop edges becomes deformed easily as soon as the support of the lower part of the skier's leg is off-centered with respect to the slit, especially as the tongues or cables, due to their flexibility, accompany these deformations.

Still by way of example, European Patent Publication Nos. 0 371 915 and 0 302 414 disclose adjustment devices of the same type as previously are mentioned, but which are provided with flaps journalled at the lower portion of the vertical scallop which they close, either by covering it, or by being positioned beneath it. In these adjustment devices, it is the flaps that act on the scallop edges and determine the modification of the envelopment contour of the upper on the lower part of the leg by means of adjustable linkage elements located on the wings of the flaps. Unlike the aforementioned adjustment devices, these devices block the scallop edges in the direction of both their coming close together and spacing apart, and therefore ensure a firm support for the lower part of the wearer's leg, even if the direction of the forces is off-centered with respect to the scallop.

On the contrary, because they use flaps that are essentially journalled at the lower portion of the scallop, the support surface or zone which the flaps offer for the lower part of the leg varies according to their inclination. Indeed, when the flap is tilted backward to increase the envelopment perimeter of the upper, the offered support surface is substantially equal to the total support surface of the flap, which makes it possible to disperse the pressures over a large surface. On the contrary, as the flap is more tilted forward to reduce the envelopment perimeter of the upper, the offered support surface is further reduced toward the upper edge of the flap. In this case, the forces of the lower part of the leg are only distributed over a small surface, which generates painful over-pressures for the wearer in this zone of contact with the flap.

Adjustment devices are also known that comprise a strap for tightening a vertical scallop obtained at the front and/or rear of a ski boot upper. In the example described in French Patent Publication No. 2 345 960, the strap totally surrounding the boot upper and is fixed, in its median portion, at two points located on both sides of the scallop, whereas its free ends are provided with a tightening device. Such a strap makes it possible to block the two scallop edges at a desired spacing, and therfore to adjust the envelopment contour of the upper in this area, but its requires the tightening of the upper to be provided on the lower part of the leg at the same level since it is the ends of the strap that carry the tightening device.

This arrangement is in fact not well-adapted for skiing techniques because a good front-rear balancing of the skiers passes necessarily through a rear support zone that is relatively firm and positioned clearly higher than that acting as the front support. Indeed, the articular physiology of the skier's leg and its musculature cannot prevent the body from falling backward, whereas it is the reverse toward the front, the muscle efficiency being furthermore optimum if the lower part of the leg can bend over a certain amplitude while being supported on the front portion of the boot upper.

Furthermore, the provision of a complete strap that surrounds the lower part of the leg to fulfill both a function for adjusting the scallop and a tightening function is difficult to define technically. Indeed, the adjustment of the scallop requires a blocking of its edges, therefore a substantial rigidity of the median portion of the strap, whereas the tightening necessitates a substantial flexibility of the free ends of the strap.

SUMMARY OF THE INVENTION

An object of the present invention is overcome and to propose an adjustment device which, after adjustment in the selected position, is capable of blocking, rigidly and in all directions, the portion of the contour of the boot upper where it is located, while guaranteeing a uniform envelopment over almost the entire height of the upper and in the extension of the wall thereof, thus avoiding over-pressures in the zone that is adjusted upon contact with the lower part of the leg.

Another object of the invention is to preserve the sealing of the upper in the location of the adjustment device.

The objects of the invention are achieved, on the one hand, by providing in the boot upper, on the portion of its contour where one desires to adjust and adapt its envelopment perimeter, a substantially vertical scallop, upwardly open, whose lower portion is located toward the base of the upper, in the transition zone between the lower part of the leg and the ankle of the wearer of the boot and, on the other hand, by providing the adjustment device with a relatively rigid strap that is blocked rigidly and in all directions, by means of maintenance means, on both sides of the scallop. Adjustable and detachable fixing means, operating between the strap and the upper, are provided to vary the position of the strap in relation to the upper, in a transverse direction with respect to the median longitudinal axis thereof, by more or less bringing the scallop edges close together.

Due to these arrangements, the strap ensures continuity of the upper edge of the upper in the same manner as a material bridge which would be made of one piece with the wall of the upper, and the position of the lower portion of the scallop makes it possible to adjust the wall of the upper adjacent to the scallop edges over almost the entire height of the portion of the lower part of the leg of the wearer of the boot that is introduced in the upper thereof. This characteristic guarantees a uniform envelopment likewise in the continuity of the wall of the upper and avoids over-pressures localized in the area adjusted to the perimeter and/or to the morphology of the lower part of the leg.

To preserve the sealing of the upper, a sealing element closes the scallop totally and uniformly. This sealing element is constituted by the strap itself, which is then provided to cover the scallop, either from the inside or from the outside, or is constituted by an element that adapts to the spacing of the scallop edges. This element is attached on the upper or is made in one piece with the wall thereof.

According to the invention, the sport boot with a lengthy upper is closed by means of tightening devices for maintaining it on the lower part of the wearer's leg, and comprises a device for adjusting a portion of its contour that is adapted to modify its envelopment perimeter independently of the tightening devices, the adjustment device having, on the one hand, a scallop that is substantially vertical and open upward, obtained in the wall of the upper, and on the other hand, a linkage element transversely connecting the edges of the scallop. Such a boot can be intended for alpine ski, cross country ski, in-line or conventional roller skating, ice skating, hiking, etc.

The boot of the invention has a linkage element which is a strap, with a rigidity at least equivalent to that of the wall of the upper, that is fixed rigidly and only on both sides of the scallop and in the upper zone thereof to block its edges reciprocally. Adjustable fixing means cooperating between the strap and the upper are provided to vary the position of the strap in relation to the upper, transversely to the median longitudinal axis thereof. The lower portion of the scallop of the boot is located toward the base of the upper, in the zone corresponding to the transition zone between the lower part of the leg and the ankle of the wearer of the boot.

BRIEF DESCRIPTION OF THE DRAWINGS

Other characteristics and advantages of the invention will be better understood upon reading the description that follows and with reference to the annexed drawings giving, by way of example, several embodiments applied to a ski boot.

FIG 1 is a perspective view of a ski boot whose upper is provided with an adjustment device according to a first embodiment;

FIG. 2 is a top view of the ski boot of FIG. 1 showing the principle of adjustment of the upper;

FIGS. 5 and 6 show different embodiments of the means for fixing an adjusting a strap that is equivalent to that of the adjustment device of FIG. 1;

FIGS. 7 and 8 show other embodiments of a strap of an adjustment device; and

DETAILED DESCRIPTION OF THE PREFERRED EMBODIMENTS

Figure 3:
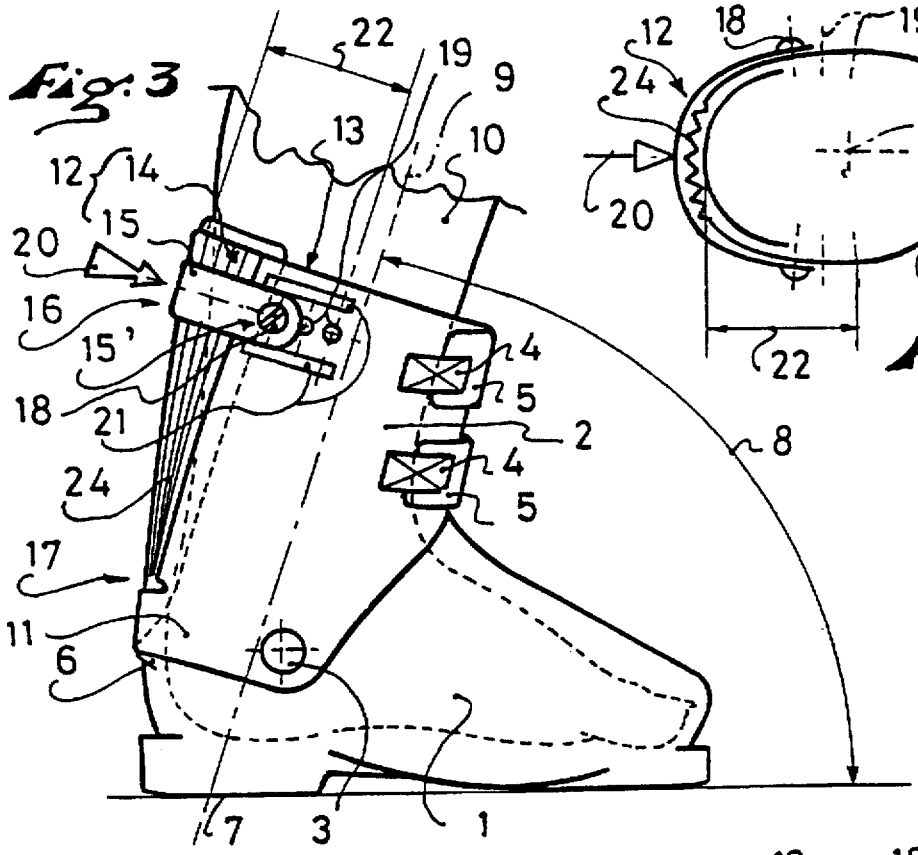
FIG. 3, 3*a*, 4, and 4*a* show the boot of FIG. 1 with its adjustment device in its extreme adjustment positions, FIGS. 3 and 3*a* showing an adjustment of the rear of the upper to increase the envelopment perimeter, and FIGS. 4 and 4*a* an adjustment of the rear of the upper to reduce the perimeter, independently of the tightening devices.
Figure 4:
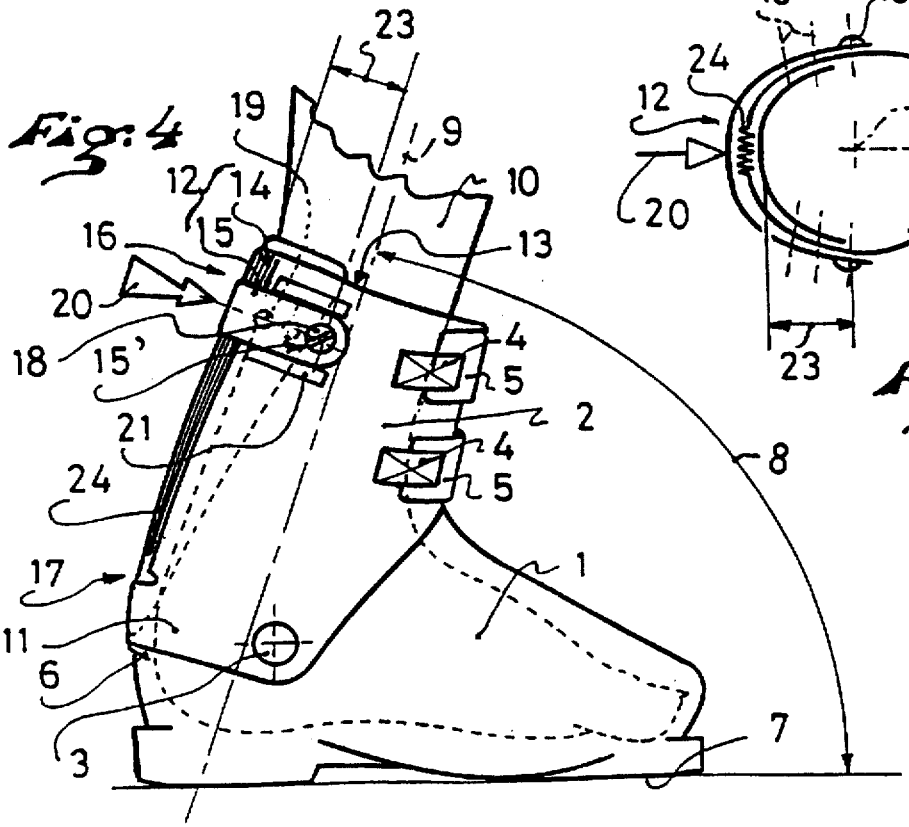

The boot shown in FIGS. 1–4*a* comprises a lower portion 1 or shell base, adapted to house the wearer's foot and a climbing upper 2 attached and connected to the shell base 1 by a pivotal linkage 3 in the zone corresponding to that of the ankle joint, the lower edge 11 of the upper overlapping the upper edge 11' of the shell base 1. An abutment 6 located on the shell base 1 in the heel zone prevents the upper 2 from rocking backward beyond a predetermined angular position with respect to the shell base 1, and thus determine what is commonly referred to as the advance angle, i.e., the angle indicated by the reference numeral 8, formed between the median longitudinal axis 9 of upper 2 and the plane of the sole 7, as shown in FIGS. 1, 3 and 4. Due to this arrangement of a rear abutment and to the fact that the upper 2 is closed on the lower part of the wearer's leg 10, the lower part of the leg 10 is likewise retained toward the rear in an angular position corresponding substantially to that of the upper 2, as shown in FIGS. 3 and 4. The closure of the upper 2 is done by means of tightening devices 4 which fasten opening-closure flaps 5 on the front portion.

A device 12 for adjusting a portion of the contour of the upper 2 is arranged on the latter, in the vicinity of its upper edge 13, so as to allow for a modification of the envelopment perimeter without acting on the tightening devices 4. The adjustment device 12 has a scallop 14 that is substantially vertical and open toward, obtained in the wall of the upper 2, and a linkage element 15 formed by a strap that is fixed on both sides of the scallop 14 in the upper zone 16 thereof, in the vicinity of the upper edge 13 of the upper 2.

According to a characteristic of the scallop 14, its lower portion 17 is located toward the base of the upper 2, in the transition zone between the lower part of the leg and the ankle or, in this example, in the vicinity of the lower edge 11.

Detachable fixing means 18, such as screws, attach the strap 15 on the upper 2 according to various positions determined by a plurality of mounting locations 19, such as plurality of holes obtained in the upper 2. It is thus possible to vary the position of the strap 15 relatively to the upper 2, in a transverse direction 20 with respect to the median longitudinal axis 9 thereof by causing, thereby, the reduction or enlargement of the scallop 14 depending upon whether the strap is in the forward, FIGS. 4 and 4*a*, or rearward, FIGS. 3 and 3a, extreme adjustment position. Since the scallop 14 extends from the upper edge 13 up to the vicinity of the lower edge 11 of the upper 2, the wall of the latter adjusts over almost the entire height adjacent to the edges which demarcate the scallop 14, i.e., over the entire height of the portion of the lower part of the leg 10 introduced and tightly enclosed in the upper 2.

To avoid risks of deformations of the wall of the upper 2 on both sides of the scallop 14 when the supports or forces transmitted by the lower part of the leg 9 are off-centered, the strap 15 is rigidly fixed in position on the upper 2 by maintenance means 21 with which the fixing means 18 cooperate for all mounting locations. These maintenance means 21 are for examples longitudinal lateral projections between which the ends 15' of the strap 15 are guided. The projections 21 thus maintain the strap 15 in the vertical direction, whereas the fixing means 18 block it in the horizontal direction. The strap 15 is thereby blocked in all directions. To ensure that the envelopment of the upper 2 is continuous in the same manner as a material bridge that would be obtained in one piece with the wall of the upper 2, the strap 15 is made of a material or with forms such that its rigidity is at least equivalent to that of the wall of the upper 2.

Figure 3A:
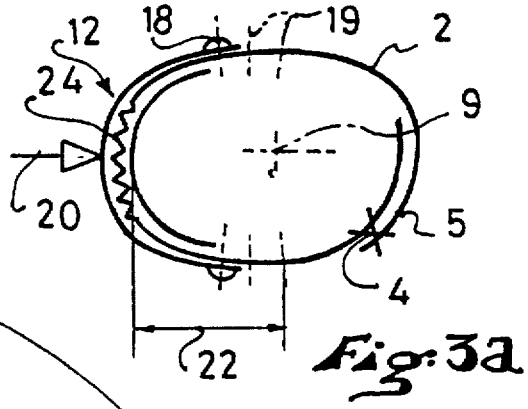

FIGS. 3 and 3a show, by way of example, the operation of the adjustment device 12 to adapt the envelopment of the upper 2 to the morphology of the lower part of a leg 10 having a large calf. In this example of adaptation, the upper 2 is assumed to have an advance angle 8 corresponding to that desired by the wearer, and consequently, the adjustment occurs, not by tightening the devices 4, but by fixing the strap in a retracted position 22 while using the appropriate mounting locations 19. As shown, mounting locations 19 have been used which correspond to the adjustment position providing the most substantial increase in the envelopment of the rear portion of the upper 2.

Figure 4A:
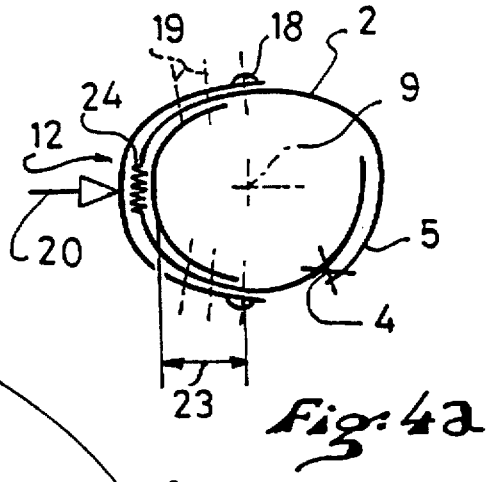

Conversely, in FIGS. 4 and 4a, when this relates to a lower part of the leg 10 having a small calf, the strap 15 is fixed in an advanced position 23 in order to reduce the envelopment of the rear portion of the upper 2. As is schematically shown in FIGS. 3, 3a, 4 and 4a, the tightening devices 4 remain in their initial position to pass from the retracted position 22 to the advanced position 23, which guarantees maintenance of the front of the lower part of the leg 10 along an advance angle 8 that is constant in spite of the difference of morphology between the two lower parts of the leg 10.

It is obvious that the adjustment that comprises moving back the strap 15 according to FIGS. 3 and 3a can also provide a modification of the advance angle if it is made for a lower part of a leg 10 having a small calf as that of FIGS. 4 and 4a. In this case, the lower part of the leg takes a straightened position and the tightening devices 4 are then tightened and/or adjusted so as to compensate for the increase in the envelopment of the rear portion of the upper 2. The reverse, i.e., when the strap 15 is advanced, for a lower part of a leg 10 with a large calf, the lower part of the leg is forced to bend further frontward and the tightening devices 4 are loosened to compensate for the decrease in the envelopment of the rear portion of the upper 2.

To guarantee the sealing of the adjustment device 12 that has just been described, a sealing bellows tongue 24 is arranged on the upper 2 et covers the entire scallop 14. Since the latter is subject to spacing variations according to the adjustments made to adapt to the lower part of the wearer's leg 10, this bellows tongue is provided to be at least deformable, or even elastic, in order to follow these variations. Advantageously, the bellows tongue 24 is obtained by molding in one piece with the wall of the upper 2 and, due to the relative rigidity of the latter, it is obtained in a low thickness and a pleated shape.

FIG. 5 shows a strap 15 obtained with a plurality of mounting locations 19 for its attachment on the upper 2 which is also provided with a plurality of mounting locations 19. This arrangement allows for a multitude of adjustment positions and, therefore, a greater precision of adjustment.

FIG. 6 shows another embodiment of the maintenance means 21 of the strap 15. This embodiment relates to bosses 21 obtained on the upper 2 adapted to cooperate with mounting locations 19 constituted by holes that have a corresponding shape, the fixing means 18 ensuring the assembly by mutual nesting of holes-projections. It is understood that the number of bosses 21 and of mounting locations 19 is not limited.

In the embodiment of the adjustment device 12 shown in FIG. 7, the strap 15 extend on the scallop 14 which it covers entirely up to the lower portion 17 thereof, from within the upper 2. The strap 15 then has a curved elongated shape which, closely assuming the profile of the opposing portion of the upper, constitutes in fact the equivalent of the maintenance means 21.

According to a variation, the strap 15 of the type of that of FIG. 7 can comprise, as shown in FIG. 8, a flap 25 that overlaps both a portion of the upper edge 13 of the upper 2 and the entire upper portion of the scallop 14. Flap 25 then likewise constitutes the equivalent of the maintenance means 21. Advantageously, flap 25 can be blocked against the upper 2 with the help of fixing means 18 of the strap 15.

In the embodiments of the strap 15 of FIGS. 7 and 8, the latter extends within the upper 2 of the boot, but can be also positioned outside thereof, thereby constituting a sealing means since it then covers the scallop 14.

Figure 9:
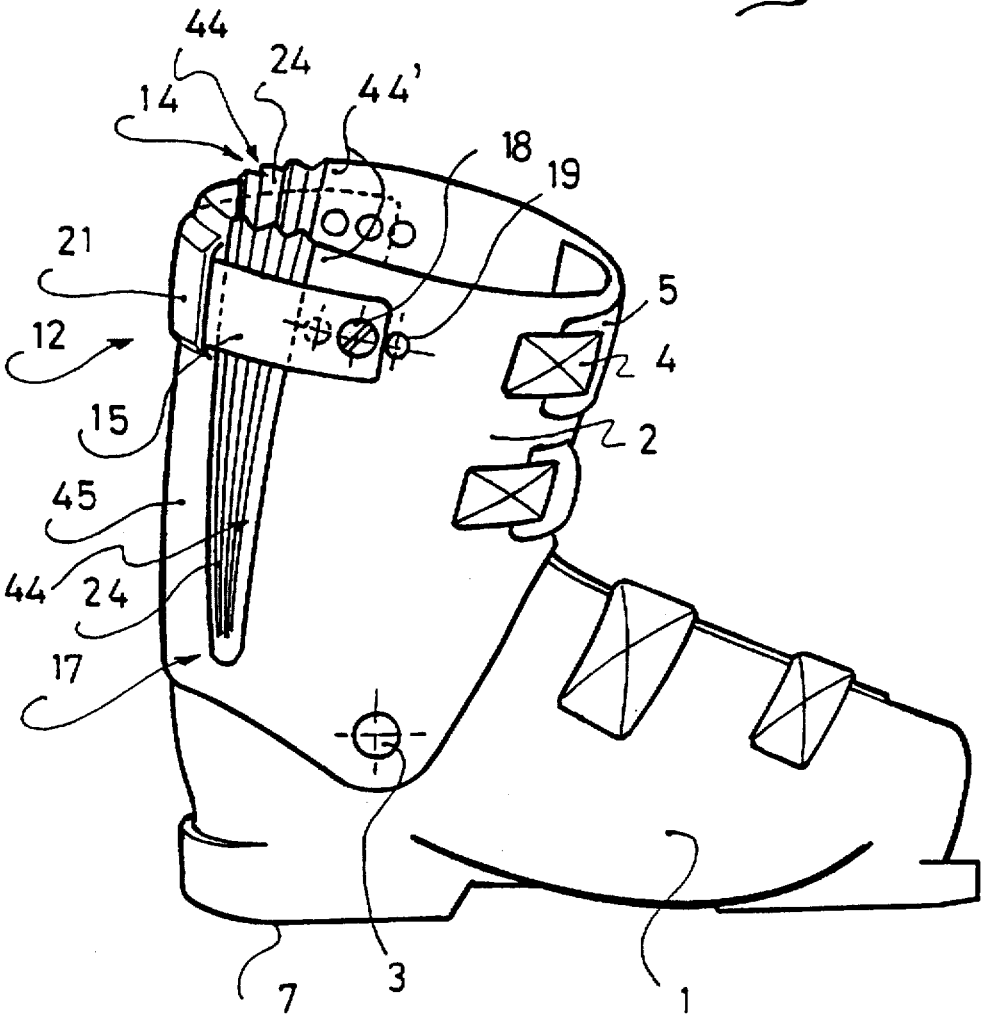
FIG. 9 is a side and top view of a ski boot provided with an adjustment device according to a second embodiment.

FIG. 9 shows an adjustment device 12 obtained in a another form. In the latter, the scallop 14 is in fact demarcated by the front edges 44' of two vertical slits 44 that are opened upward. The two slits 44 demarcate between them a strap-holding tongue 45 which is obtained with a keeper constituting the maintenance means 21 of strap 15 which, in cooperation with the fixing means 18, ensure blocking thereof in all directions.

It is understood that in such an embodiment, each slit can be provided with a sealing element such as a bellows tongue 24.

In the example described hereinabove, with reference to FIGS. 1–9, the adjustable fixing means 18 and 19 are arranged so as to be accessible from outside of the upper 2, but they can also be positioned so as to be accessible from within the upper 2.

The instant application is based upon French Patent Application No. 95.04298, filed on Apr. 6, 1995, the disclosure of which is hereby expressly incorporated by reference thereto in its entirety and the priority of which is claimed under 35 USC 119.

Although the invention has been described with reference to particular means, materials, and embodiments, it is to be understood that the invention is not limited to the particulars expressly disclosed, but the invention extends to all equivalents within the scope of the claims that follow.

What is claimed is:

1. A sports boot comprising:

a lower foot portion and an upper having a top and base, the upper which closes by means of tightening devices for maintaining it on the lower part of the wearer's leg, and which comprises a device for adjusting a portion of its contour adapted to modify the envelopment perimeter of the upper independently of the tightening devices, the adjustment device having a scallop that is substantially vertical and open upward and obtained in the wall of the upper, and a linkage element transversely connecting the edges of said scallop, wherein the linkage element is a strap having a rigidity at least equivalent to that of the wall of the upper, which is fixed rigidly and only on both sides of the scallop and in the upper zone of the scallop to reciprocally block its edges and to ensure continuity of the upper edge of the upper, an adjustable fixing device intervening between the strap and the upper being provided to vary the spacing of the scallop edges by modifying the position of said strap in relation to the upper, transversely to the median longitudinal axis of the upper, and wherein a lower portion of the scallop is located toward the rear base of the upper in the zone corresponding to the transition zone between the lower part of the leg and the ankle of the wearer of the boot.

2. A sport boot according to claim 1, wherein the scallop is defined by two lateral slits between which a strap-holding tongue is located.

3. A sport boot according to claim 1, wherein the strap is blocked in all directions and fixed rigidly on both sides of the scallop by the strap adjustable fixing device which cooperate with a positioned maintenance device constituted by portions that are nested between them and obtained on the upper and the strap.

4. A sport boot according to claim 1, wherein the adjustable fixing device is constituted by detachable assembly elements operating by one of screwing, nesting, and stapling and by a plurality of locations for adjustable mounting obtained on the strap and upper.

5. A sport boot according to claim 1, wherein the strap extends within the boot upper towards the lower portion of the scallop which it closes from the inside by overlapping the scallop.

6. A sport boot according to claim 1, wherein the strap extends outside the boot upper at the upper portion of the scallop which it closes from the outside by overlapping the scallop upper portion.

7. A sport boot according to claim 1, wherein the scallop is entirely and uniformly closed by a sealing element that adapts to the spacing of the scallop edges.

8. A sport boot according to claim 7, wherein a sealing bellows tongue is provided by molding in one piece with the wall of a boot upper.

9. A sport boot according to claim 1, wherein the boot upper is attached and connected to the lower portion housing the foot which it overlaps partially and perimetrically by a pivoting linkage located substantially in the zone of the ankle joint, and wherein the lower portion of the scallop is located in an overlapping zone of the upper on the lower portion housing the foot.

10. A sport boot according to claim 1, wherein the strap is provided with a flap that overlaps at least one portion of the upper edge of the upper.

11. A sport boot according to claim 10, wherein the flap of the strap is retained on the upper edge of the upper by the adjustable fixing device for retaining the strap on the upper.

* * * * *